US007350440B2

(12) United States Patent
Casolco

(10) Patent No.: US 7,350,440 B2
(45) Date of Patent: Apr. 1, 2008

(54) FRAMING HAMMER ASSEMBLY

(76) Inventor: Roberto R. Casolco, 2122 Middlebury Dr., Aurora, IL (US) 60503

( * ) Notice: Subject to any disclaimer, the term of this patent is extended or adjusted under 35 U.S.C. 154(b) by 0 days.

(21) Appl. No.: 11/354,691

(22) Filed: Feb. 15, 2006

(65) Prior Publication Data

US 2007/0186727 A1 Aug. 16, 2007

(51) Int. Cl.
*B25D 1/00* (2006.01)
*B25D 1/14* (2006.01)
*B25F 1/00* (2006.01)

(52) U.S. Cl. ..... 81/20; 81/26; 81/143; 81/164

(58) Field of Classification Search ..... 81/20–26; 7/143–145, 164

See application file for complete search history.

(56) References Cited

U.S. PATENT DOCUMENTS 468,191 A * 2/1892 Chambers ..... 81/26
731,916 A * 6/1903 Koegel ..... 7/144
2,501,757 A * 3/1950 Cagle ..... 7/145
4,240,478 A 12/1980 Wilson
4,290,583 A * 9/1981 Lombardi ..... 81/20
4,561,635 A 12/1985 Lamansky
4,732,058 A 3/1988 Chung
5,159,858 A 11/1992 Gansen
5,765,807 A 6/1998 Heath
5,826,466 A 10/1998 Weissbach
6,332,376 B1 12/2001 Hurley
6,460,210 B1 10/2002 Alpert
6,604,728 B1 8/2003 Boydon

* cited by examiner

*Primary Examiner*—Hadi Shakeri
(74) *Attorney, Agent, or Firm*—Meroni + Meroni, P.C.; Charles F. Meroni, Jr.; Christopher J. Scott

(57) ABSTRACT

A framing hammer assembly enables a user to tend to nail work within tight spaces. The hammer assembly comprises a three-dimensional hammer head, an elongate hammer handle, and a select tool attachment assembly. The hammer head comprises first and second nail-striking heads, a fulcrum, and a nail-pulling claw. The first nail-striking head and the second nail-striking head are orthogonally situated relative to one another for enabling a user to drive nails within tight spaces. The hammer handle comprises a head-engagement portion, a second handle end, and a hand-grip portion. The select tool attachment assembly comprises a select tool accessory and certain fastening structure for fastening the select tool accessory to the second handle end. The select tool accessory is interchangeable with a plurality of secondary tool accessories for selectively providing a lever arm and for enabling the user to remove driven nails or similar other hardware within tight spaces.

9 Claims, 4 Drawing Sheets

FRAMING HAMMER ASSEMBLY

BACKGROUND OF THE INVENTION

1. Field of the Invention

The present invention generally relates to a concrete type framing hammer assembly. More particularly, the present invention relates to a framing hammer assembly for driving nails within tight spaces and further for removing nails from within tight spaces.

2. Description of Prior Art

It is noted that common prior art hammers comprising a nail-striking head and a nail-pulling claw (opposite the nail-striking head) often cannot be properly utilized to drive nails because the open space adjacent the nail to be driven, within which the user may wield the hammer to generate a driving force, is insufficient to allow for the hammer to be used in a typical hammering manner. Notably, the width of common prior art hammering heads are often used by users in the construction arts to drive nails in rather tight spaces. Further, it is often useful to have a measuring device on the spot to lessen construction effort and cost. Prior art hammering devices incorporating measurement means are known in the arts. Some of the more pertinent prior art disclosures relating to hammering devices and the like attempting to address the types of structural shortcomings implicit in the foregoing introduction, are briefly described hereinafter.

U.S. Pat. No. 4,732,058 ('058 Patent), which issued to Chung, discloses a Measuring Hammer. The '058 Patent teaches a measuring hammer which is constructed in such a manner as to provide locations in the hammer with specific dimensions so that the hammer itself can be used to make measurements normally required in the construction field. Also, a nail holding aperture is disposed in the head portion thereof for starting a nail into the wood. Advantageously, the measuring hammer contains measurements of 1.5", 12", 16" or 24".

U.S. Pat. No. 5,159,858 ('858 Patent), which issued to Gansen, discloses a Framing Hammer Construction. The '858 Patent teaches a framing hammer construction in which a conventional hammer head is provided with first and second bosses. The first boss is permanently secured to one side of the hammer head, this boss containing double tapered grooves for releasably holding laterally projecting nails. Notably, the second boss is a flattened boss on the side of the hammer head opposite to the grooved boss for driving nails with sideways blows of the hammer head.

U.S. Pat. No. 5,826,466 ('466 Patent), which issued to Weissbach, discloses a Multipurpose Hammer. The '466 Patent teaches a multi-purpose hammer that starts nails with the use of only one hand, drives nails in restricted areas, and draws circles. The hammer includes a handle, a head, and holding apparatus. The head extends generally perpendicularly from the handle, at an end thereof. The holding apparatus is associated with the head and holds the nail and includes a pair of dimples in a surface of an intermediate portion of the head. Another surface of the intermediate portion of the head has a striking surface that drives a nail in the restricted area by reducing the needed swing. And, the handle of the hammer has a plurality of grooves therealong with inch indicia next thereto that function as the radius of the circle, with the nail in one dimple functioning as the center of the circle and a marking device inserted into a desired groove with the handle being swung and marking the circle.

U.S. Pat. No. 6,332,376 ('376 Patent), which issued to Hurley, discloses a Hammer with Replaceable Nail Striking Head. The '376 Patent teaches a hammer including an elongated handle having a top end and a bottom end and a hammer head mounted on the top end of said handle, the hammer head including a body section and a rigid nail striking head section having a nail striking face. A nail pulling device is mounted on the handle, the nail pulling device having a nail-engaging plate and at least one generally keyhole-shaped slot formed therein, the slot including an access opening having a relatively wide transverse dimension sized to receive a nail head therethrough and a narrowed groove section having a transverse dimension smaller than the transverse dimension of the access opening and sized to inhibit passage of a nail head therethrough, the nail pulling device operating such that the head of a nail to be pulled is moved through the access opening of the slot and the hammer is positioned to secure the nail in the groove section.

U.S. Pat. No. 6,460,210 ('210 Patent), which issued to Alpert, discloses a Multi-Purpose Hammer. The '210 Patent teaches a hammer including a body having opposed, non-parallel cutting edges, and a cross bar attached to the body having a substantially flat side arranged relative to the cutting edges to permit left and right handed cutting. The cross bar includes a hammer head defining a central axis positioned off-axis of a central axis of the cross bar. The cross bar has a claw and a pointed end. The hammer includes a handle attached to the body. The handle defines a central axis positioned off-axis of a central axis of the body. The body of the hammer includes a handle stem with splines for receiving the handle and limiting rotation of the handle relative to the body.

U.S. Pat. No. 6,604,728 ('728 Patent), which issued to Boyden, discloses a Multiple Use Hammer. The '728 Patent teaches a multiuse hammer having multiple pry features of varying configurations as well as a striking face on an enlarged head portion. One feature is formed on the handle end, another long length straight but angled claw on the head portion, and a pry tooth projects to one side of the claw.

From an inspection of the foregoing disclosures and from a consideration of other art generally known to exist it will be seen that the prior art fails to teach a combination framing hammer construction having a hammer head incorporating two nail-striking heads, orthogonally situated relative to one another, one oriented lengthwise and one oriented widthwise for driving nails within tight spaces, which hammer head is cooperatively associated with a hammer handle having select tool attachments associated with the end opposite the hammer head for providing lever means and enabling users to remove driven nails from tight spaces. The prior art thus perceives a need for a combination framing hammer as briefly described herein.

SUMMARY OF THE INVENTION

It will thus be seen, in contradistinction to the foregoing prior art, that the present invention provides a framing hammer assembly primarily for enabling a user to tend to nail work (driving and removing nails) within tight spaces. The framing hammer assembly comprises, in combination, a three-dimensional hammer head, an elongate hammer handle, and a select tool attachment assembly. The hammer head, being three-dimensional, extends in an x-direction, a y-direction, and a z-direction, and comprises first and second nail-striking heads, a (superior) fulcrum, and a nail-pulling claw. The first nail-striking head and the second nail-striking head are orthogonally situated relative to one another, one lengthwise opposite the nail-pulling claw, and one widthwise intermediate the first nail-striking head and the nail-pulling claw.

The hammer handle comprises a handle axis, a first handle end, a second handle end, a head-engagement portion, and a hand-grip portion. The second handle end comprises certain tool assembly-receiving means for receiving the select tool attachment assembly. The select tool attachment assembly comprises a select tool accessory and certain handle attachment-means for fastening the select tool accessory to the second handle end. The select tool accessory is interchangeable with a plurality of secondary tool accessories for selectively providing a lever arm and for enabling the user to remove driven nails or similar other hardware within tight spaces.

Other objects of the present invention, as well as particular features, elements, and advantages thereof, will be elucidated or become apparent from, the following description and the accompanying drawing figures.

BRIEF DESCRIPTION OF THE DRAWINGS

Other features of our invention will become more evident from a consideration of the following brief description of my patent drawings, as follows.

DETAILED DESCRIPTION OF THE PREFERRED EMBODIMENT

Figure 1:
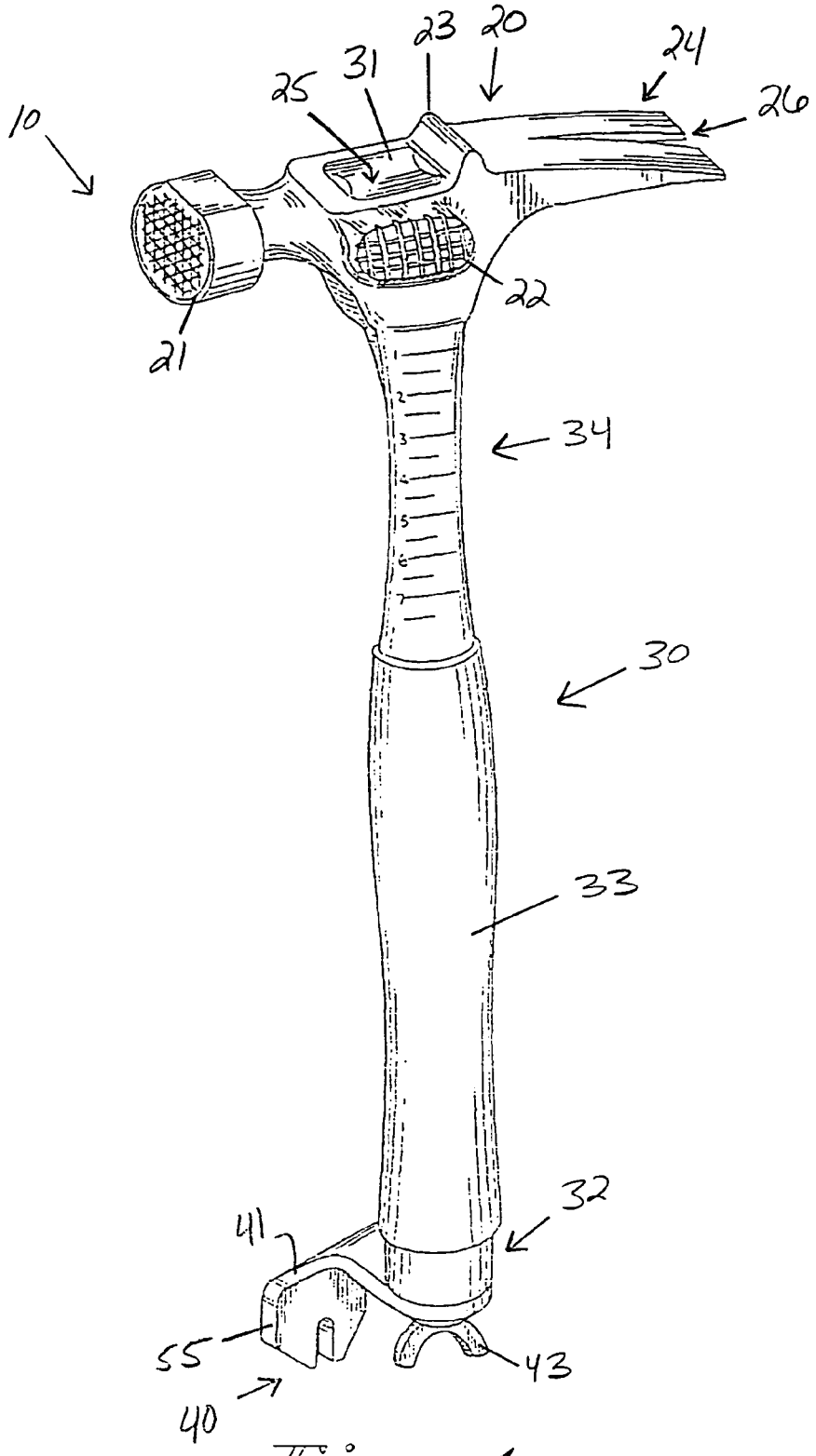
FIG. 1 is a top perspective view of a preferred embodiment of the framning hammer assembly in an assembled state.

Referring now to the drawings, the preferred embodiment of the present invention concerns a (concrete-type) framing hammer assembly 10 as generally illustrated and referenced in FIG. 1. It is contemplated that the framing hammer assembly 10 may effectively function to drive nails within tight spaces such as between walls 100 (as generally depicted in FIG. 8). This is particularly the case when an installer frames a wall and thus is required to drive nails all along foundational concrete. Further, it is contemplated that the framing hammer assembly 10 may effectively function to remove nails within tight spaces, which tight spaces may also defined by the foregoing. It is noted that the term "tight" is a relative term. In this regard, it is noted that the hammer head 20 of the present invention (as generally illustrated and referenced in FIGS. 1 and 7-10) is illustrated as being positioned widthwise intermediate walls 100 in FIG. 8. If hammer head 20 were to be positioned lengthwise intermediate walls 100, it is conceivable that the use may have insufficient space to create a driving force to drive the nail 101 into wall 100 as is otherwise generally depicted in FIG. 8. Thus, it is contemplated that the term tight spaces as herein utilized is meant to define those spaces wherein a lengthwise hammer head arrangement would thwart the user from having sufficient space to create sufficient driving force to drive nail 101.

Figure 2:
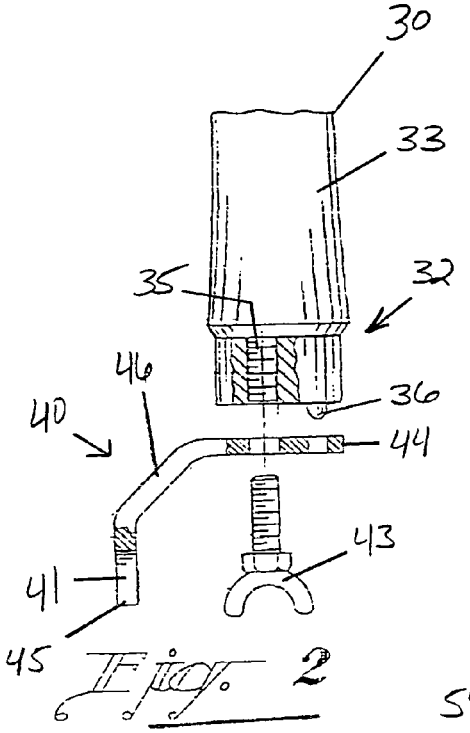
FIG. 2 is a fragmentary exploded plan type view of the second handle end with certain parts broken away to show fastener-receiving structure adjacent a select tool accessory and a wing type screw member for fastening the select tool accessory to the second handle end via the fastener-receiving structure.

The framing hammer assembly 10 preferably comprises a three-dimensional hammer head 20 as previously noted; an elongate hammer handle 30 as generally illustrated and referenced in FIGS. 1, 2, and 7-10; and a select tool attachment assembly 40 as generally illustrated and referenced in FIGS. 1 and 2. Having three-dimensions, the hammer head 20 inherently extends along an x-axis as referenced by a point 102 in FIG. 9 and as referenced by broken line 102 in FIG. 10; a y-axis as referenced by a broken line 103 in FIG. 9 and as referenced by a point 103 in FIG. 10; and a z-axis 104 as referenced by broken lines in FIGS. 9 and 10. It will be understood from an inspection of the noted figures that a right-handed Cartesian coordinate system is being used to describe the hammer head 20 and attendant structures. According to classical coordinate system principles, it will be readily understood that the x-axis and z-axis together lie in an x-z plane; the y-axis and the z-axis together lie in a y-z plane; and the x-axis and the y-axis together lie in an x-y plane, which planes are orthogonal to one another.

Figure 7:
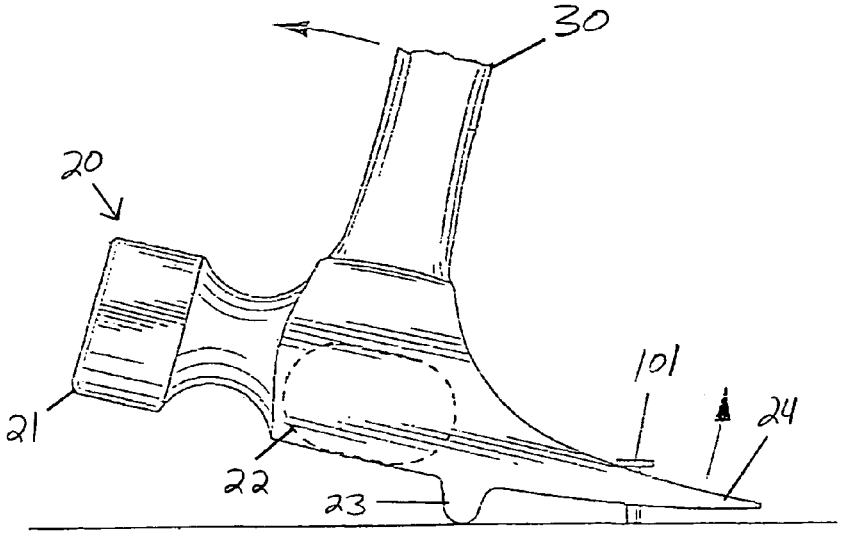
FIG. 7 is a fragmentary side view depiction of the hammer head and hammer handle showing the nail-pulling claw of the hammer head removing a driven nail as aided by an integrally formed fulcrum.
Figure 8:
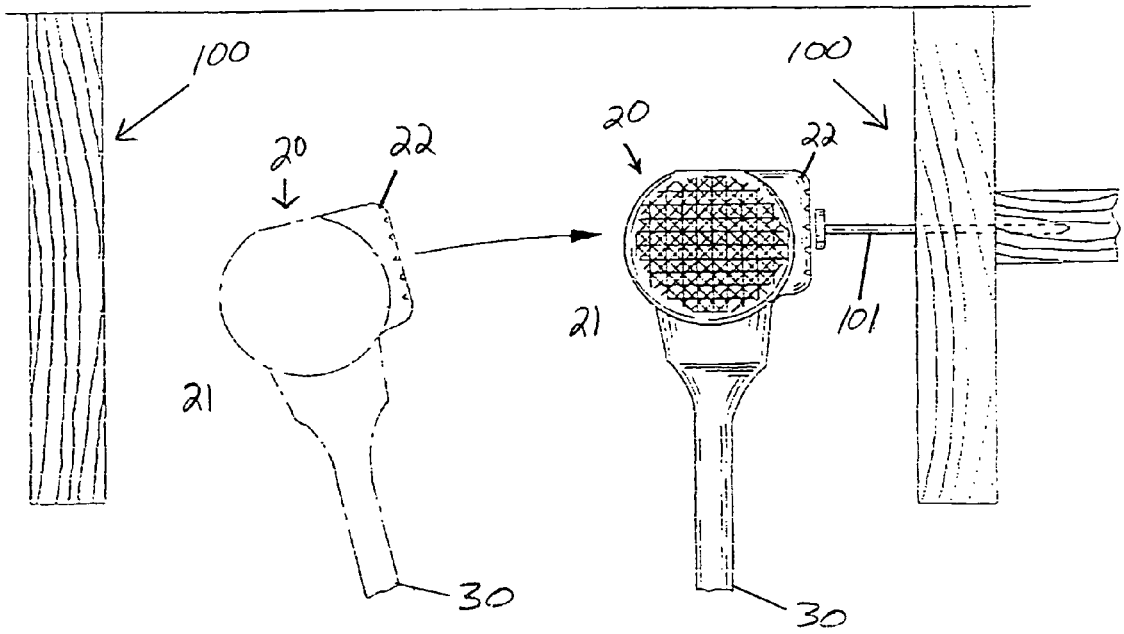
FIG. 8 is a fragmentary front view depiction of the hammer head and hammer handle showing the second nail-striking head driving a nail within a tight space.
Figure 9:
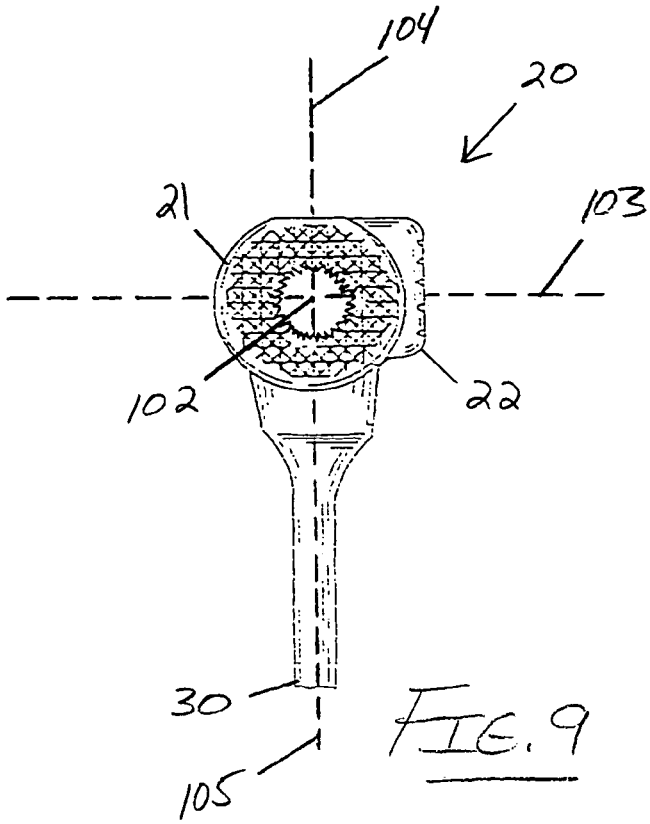
FIG. 9 is a fragmentary front view depiction of the hammer head and hammer handle with certain parts of the hammer head broken away to show the intersection of an x-axis, a y-axis, and a z-axis as situated relative to the hammer head.
Figure 10:
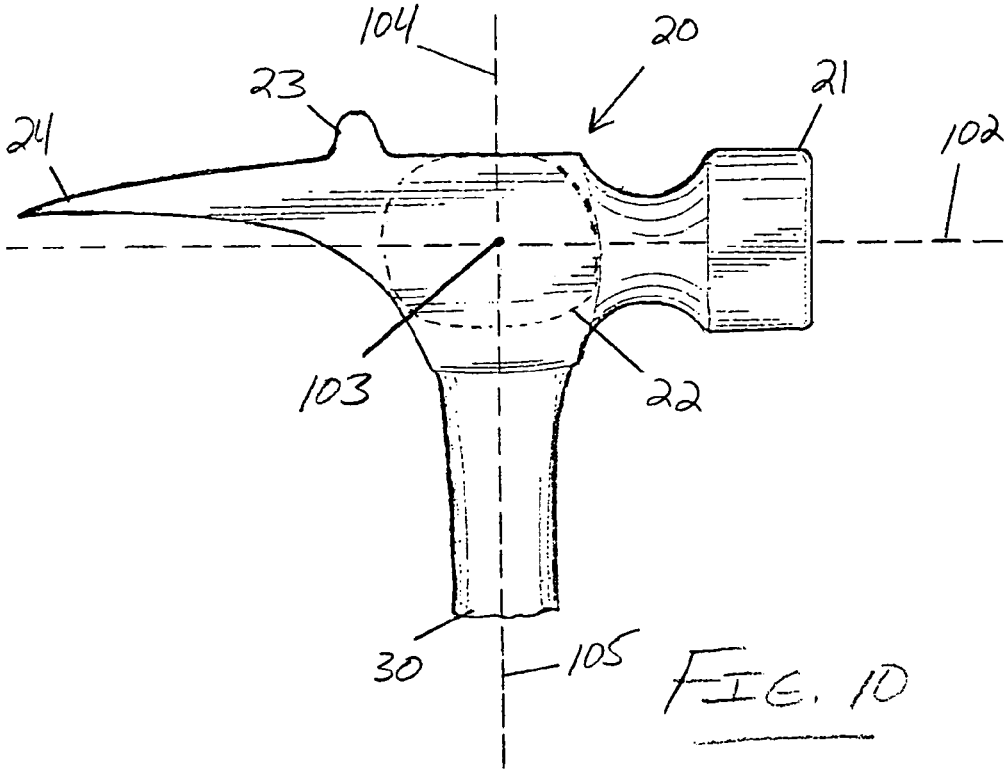
FIG. 10 is a fragmentary side view depiction of the hammer head and handle assembly showing the intersection of an x-axis, a y-axis, and a z-axis as situated relative to the hammer head.

Hammer head 20 preferably comprises a first nail-striking head 21 as illustrated and referenced in FIGS. 1, and 7-10; a second nail-striking head 22 as illustrated and referenced in FIGS. 1, and 7-10; a fulcrum 23 as illustrated and referenced in FIGS. 1, 7, and 10; a nail-pulling claw 24 as illustrated and referenced in FIGS. 1, 7, and 10; and a handle-receiving aperture 25 as generally referenced in FIG. 1 (as filled with a first handle end 31). In this last regard, it should be noted that the handle-receiving aperture 25 has a handle-receiving or tunnel axis substantially collinear with z-axis 104. Further, the first nail-striking head 21 has a first (longitudinal) head axis substantially collinear with x-axis 102, and the second nail-striking head 22 has a second (longitudinal) head axis substantially collinear with y-axis 103 as generally depicted in FIGS. 9 and 10. The nail-pulling claw 23 preferably comprising a nail-receiving groove 26 as illustrated and referenced in FIG. 1.

The fulcrum 23 essentially comprises at least two fulcrum dimensions extending in the y-axis direction and the z-axis direction (opposite hammer handle 30), as may be achieved, for example, by a planar member extending across the width of the superior surface of hammer head 20. In other words, the fulcrum 23 extends substantially parallel to the y-z plane intermediate the nail-pulling claw 24 and the handle-receiving aperture 25. Preferably, however, fulcrum 23 comprises certain third dimensional structure extending in the x-axis direction (as generally depicted in the illustrations provided) so as to enhance the operative strength of the fulcrum 23 for removing driven nails 101 as generally depicted in FIG. 7. The fulcrum 23 is preferably integrally formed with hammer head 20 to further enhance its operative strength.

The first head axis extends through a first (nail) strike plane defined by the x-z plane and the second head axis extends orthogonally to the first strike plane in a second (nail) strike plane defined by the y-z plane. A comparative inspection of FIGS. 8 and 9 will help illustrate for the reader that the framing hammer assembly 10 is movable in the second strike plane to drive nails 101 within tight spaces. The nail-receiving groove extends in mirrored or symmetric relation about the x-z plane.

The hammer handle 30 preferably comprises a handle axis 105 as referenced in FIGS. 9 and 10; a first handle end 31 as illustrated and referenced in FIG. 1; a second handle end 32 as generally illustrated and referenced in FIGS. 1 and 2; a head-engagement portion (that portion of hammer handle 30 received by handle-receiving aperture 25); an outer handle surface; and certain tool assembly-receiving means. The outer handle surface preferably comprises certain distance-measurement means and a hand-grip portion 33 as generally illustrated and referenced in FIGS. 1 and 2. The distance-measurement means enable a user to measure distances via hammer handle 30 and may be preferably defined by a series of equally-spaced indicia 34 as generally depicted in FIG. 1. From an inspection of FIG. 1 it will be seen that the equally-spaced indicia 34 are preferably longitudinally spaced adjacent the handle axis for enabling the user to more readily measure footings for walls and the like.

The first handle end 31 and the head-engagement portion are received in the handle-receiving aperture 25 such that the tunnel axis is substantially collinear with the handle axis 105 (and the z-axis). The measurement indicia 34 are preferably located intermediate the head-engagement portion and the hand grip portion 33 and the hand-grip portion 33 preferably extends intermediate the measurement indicia and 34 the second handle end 32.

It is contemplated that the select tool attachment assembly 40 of the present invention may effectively function to enable the user to remove driven nails 101 within tight spaces. The select tool attachment assembly 40 preferably comprises a select tool accessory 41 as illustrated and referenced in FIGS. 1-3, and certain handle attachment-means for attaching or fastening the select tool accessory 41 to the second handle end 32 via the tool-receiving means. The handle-attachment means may preferably be defined by certain manually removable fastening hardware such as the wing tipped screw 43 as illustrated and referenced in FIGS. 1 and 2. It is contemplated that a collapsible or hinged type of winged screw could be utilized so that the wing portion of the screw could be folded over and abutted against the end of the tool that abuts the second handle end 32. Notably, the select tool accessory 41 is interchangeable with a plurality of secondary tool accessories 42 as generally illustrated and referenced in FIGS. 4-6.

The select tool accessory 41 and secondary tool accessories 42 each preferably comprise a substantially planar handle-engaging end portion 44, a substantially planar nail-removing end portion 45, and a substantially planar end-connecting portion 46 as generally depicted in FIGS. 2-6. Generally speaking, the handle-engaging end portion 44 is preferably parallel to the x-y plane and the nail-removing end portion 45 is preferably parallel to the x-z plane when in an assembled state as generally depicted in FIG. 1. The end-connecting portion 46 is integrally formed with the handle-engaging and nail-removing end portions 44 and 45 and preferably extends therebetween at a 45 degree angle therebetween. The nail-removing end portion 45 is cooperable with a driven nail 101 for enabling the removal thereof within tight spaces.

The tool-receiving means of the second handle end 32 may preferably be defined by certain female fastener-receiving structure 35 and certain male alignment structure 36 as generally illustrated and referenced in FIG. 2. The fastener-receiving structure has an aperture axis and the alignment structure has a protrusion axis, the aperture and protrusion axes preferably being coplanar with the y-z plane. The handle-engaging portion 44 preferably comprises an attachment aperture 47 and an alignment aperture 48 as generally illustrated and referenced in FIGS. 3-6. The alignment aperture 48 receives the alignment structure 36 and the attachment aperture 47 is centered about the aperture axis. Thus, the handle-attachment means may function to fasten the select tool accessory 41 or secondary tool accessory 42 to the second handle end 32 via the fastener-receiving structure 35 as generally depicted in FIG. 2.

Figure 3:
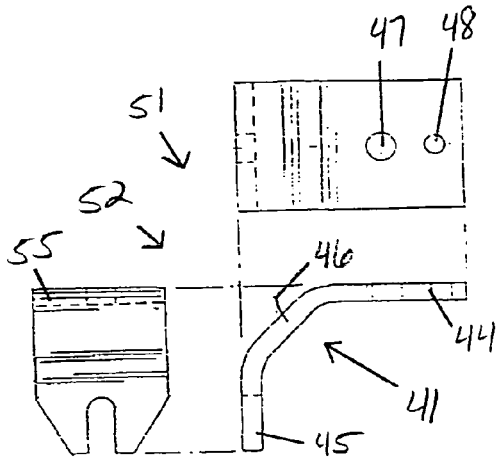
FIG. 3 is a series of three views showing a first tool accessory having a single U-shaped groove as viewed from the side thereof, an end thereof, and the top thereof.
Figure 4:
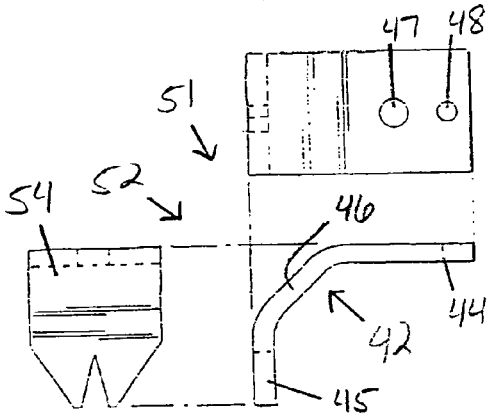
FIG. 4 is a series of three views showing a second tool accessory having a single V-shaped groove as viewed from the side thereof, an end thereof, and the top thereof.
Figure 5:
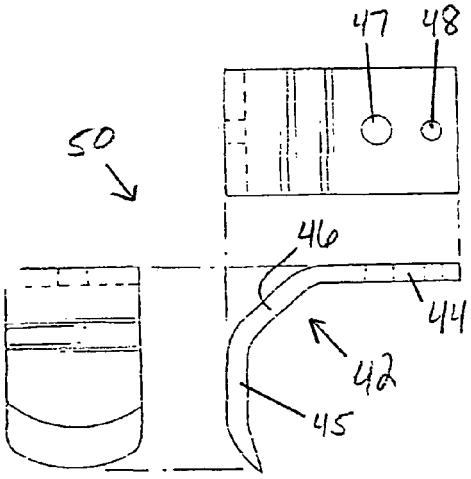
FIG. 5 is a series of three views showing a third tool accessory having a lever arm as viewed from the side thereof, an end thereof, and the top thereof.
Figure 6:
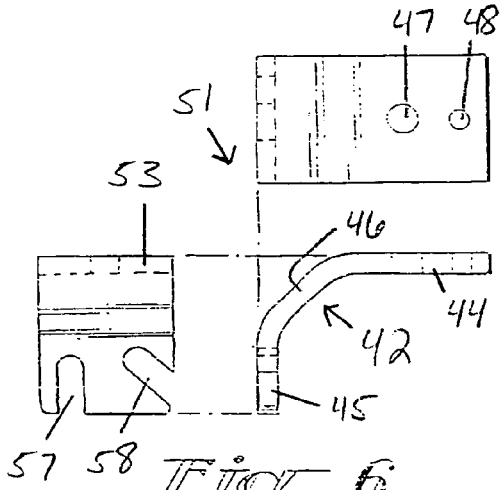
FIG. 6 is a series of three views showing a fourth tool accessory having dual U-shaped grooves as viewed from the side thereof, an end thereof, and the top thereof.

The select tool accessory 41 may preferably selected from the group consisting of a lever tool accessory 50 as generally depicted in FIG. 5 (for providing a lever arm for enabling the user to more readily lift concrete slabs and the like), and a select claw tool assembly 51 as generally depicted in FIGS. 3, 4, and 6. The select claw tool assembly may preferably be selected from the group consisting of a select uni-grooved claw tool assembly 52 as generally depicted in FIGS. 3 and 4, and a dual-grooved claw tool assembly 53 as depicted in FIG. 6. The select uni-grooved claw tool assembly may preferably be selected from the group consisting of a V-shaped groove claw assembly 54 as generally depicted in FIG. 4, and a U-shaped groove claw assembly 55 as generally depicted in FIGS. 1 and 3. The dual-grooved claw assembly preferably comprises a first U-shaped groove 57 and a second U-shaped grooves 58. From a comparative inspection of FIGS. 1, 2, and 6, it will be understood that the first U-shaped groove 57 preferably extends in substantially parallel relation to the y-z plane and the second U-shaped groove 58 preferably extends diagonally relative to the y-z plane.

When in a fully assembled state, the second nail-striking head 22 and the hammer handle 30 enable the user to drive nails 101 within tight spaces as generally depicted in FIG. 8; and the select tool attachment assembly 40 and the hammer handle 30 further enable the user to remove driven nails 101 within tight spaces as similarly located and defined. The first nail-striking head 21 and the nail-removing claw 24 function akin to a traditional prior art hammer head and thus enable the user to drive nails 101 within relatively open spaces and remove driven nails 101 within relatively open spaces as generally depicted in FIG. 7.

The framing hammer assembly 10 of the present invention thus functions to enable a user to tend to nail work within tight spaces and comprises a three-dimensional hammer head 20 and an elongate hammer handle 30, to which handle 30 a select tool attachment assembly 40 may be attached. The hammer head 20 inherently extends along an x-axis, a y-axis, and a z-axis and comprises first and second nail-striking heads, and a nail-pulling claw 24. The first nail-striking head has a first head axis and the second nail-striking head has a second head axis substantially orthogonal to the first head axis. The first head axis extends through a first strike plane definable by the x-z plane and the second head axis extends in a second strike plane definable by the y-z plane.

The hammer handle 30 comprises a handle axis, a first handle end, a second handle end, a head-engagement portion, and a hand-grip portion, the first handle end and the head-engagement portion being cooperatively associated with the hammer head 20 for enabling the user to drive nails, the second nail-striking head and the hammer handle 30 for enabling a user to drive nails within tight spaces. The select tool attachment assembly comprises a select tool accessory and certain handle attachment-means for fastening the select tool accessory to the second handle end. The select tool accessory may be interchangeable with a plurality of secondary tool accessories. The select tool attachment assembly 40 and the hammer handle 30 thus further enable the user to remove driven nails within tight spaces.

While the foregoing descriptions contain much specificity, the same should not be construed as limiting the scope of the invention, but rather as an exemplification of the invention. For example, it is contemplated that the essence of the invention teaches a hammer assembly for tending to nail work within tight spaces. The hammer assembly comprising a three-dimensional hammer head, an elongate hammer handle, and a select tool attachment assembly. The hammer head inherently extends along an x-axis, a y-axis, and a z-axis and comprises at least one nail-striking head (such as second nail-striking head 22) and certain head balance structure. When provided with a single nail-striking head, the nail-striking head has a first head axis extending along the y-axis and the head balance structure extends positively and negatively along the x-axis for balancing the nail-striking head. The head balance structure may be defined by a second nail-striking head (such as first nail-striking head 21) and a nail-pulling claw (such as nail-pulling claw 24), the second nail striking head extending positively along the x-axis and the nail-pulling claw extending negatively along the x-axis. The hammer handle comprises a handle axis (extending substantially collinear with the z-axis), a head-engagement portion, and a hand-grip portion. The head-engagement portion is cooperatively associated with the hammer head and the handle axis to enable the user to drive nails within tight spaces via the nail-striking head.

Accordingly, although the invention has been described by reference to a preferred embodiment, it is not intended that the novel assembly be limited thereby, but that modifications thereof are intended to be included as falling within the broad scope and spirit of the foregoing disclosure, the following claims, and the appended drawings.

I claim:

1. A framing hammer assembly, the framing hammer assembly for driving and removing nails within tight spaces, the framing hammer assembly comprising a three-dimensional hammer head, an elongate hammer handle, and a select tool attachment assembly, the hammer head inherently extending along an x-y plane, a y-z plane, and an x-z plane and comprising first and second nail-striking heads, a fulcrum, a nail-pulling claw, and a handle-receiving aperture, the first nail-striking head having a first head axis, the second nail-striking head having a second head axis, the nail-pulling claw comprising a nail-receiving groove, the fulcrum having at least two fulcrum dimensions, the handle-receiving aperture having a tunnel axis, the first head axis extending through a first strike plane defined by the x-z plane, the second head axis extending orthogonally to the first strike plane in a second strike plane defined by the y-z plane, the nail-receiving groove extending in mirrored relation about the x-z plane, the fulcrum extending substantially parallel to the y-z plane intermediate the nail-pulling claw and the handle-receiving aperture, the tunnel axis being substantially collinear with a z-axis, the hammer handle comprising a handle axis, a first handle end, a second handle end, a head-engagement portion, an outer handle surface, female fastener-receiving structure, and male alignment structure, the fastener-receiving structure having an aperture axis and the alignment structure having a protrusion axis, the aperture and protrusion axes being coplanar with the y-z plane, the handle-engaging portion comprising an attachment aperture and an alignment aperture, the alignment aperture receiving the alignment structure, the attachment aperture being centered about the aperture axis, the outer handle surface comprising a hand-grip portion and distance-measurement means for measuring distances via the outer handle surface, the first handle end and the head-engagement portion being received in the handle-receiving aperture such that the tunnel axis is substantially collinear with the handle axis, the measurement indicia being located intermediate the head-engagement portion and the hand grip portion, the hand-grip portion extending intermediate the measurement indicia and the second handle end, the select tool attachment assembly comprising a select tool accessory and handle attachment-means for fastening the select tool accessory to the second handle end, the select tool accessory comprising a planar handle-engaging end portion, a substantially planar nail-removing end portion, and a substantially planar end-connecting portion, the handle-engaging end portion being parallel to the x-y plane and the nail-removing end portion being parallel to the x-z plane, the end-connecting portion being integrally formed with the handle-engaging and nail-removing end portions, the nail-removing end portion being cooperable with a driven nail for enabling the removal thereof, the handle attachment means for attaching the select tool accessory to the second handle end via the fastener-receiving structure, the select tool accessory being interchangeable with a plurality of secondary tool accessories, the second nail-striking head and the hammer handle for enabling the user to drive nails within tight spaces, the select tool attachment assembly and the hammer handle for providing a lever arm and for enabling the user to remove driven nails within tight spaces.

2. The framing hammer assembly of claim 1 wherein the select tool assembly is selected from the group consisting of a lever tool accessory and a select claw tool assembly.

3. The framing hammer assembly of claim 2 wherein the select claw tool assembly is selected from the group consisting of a select uni-grooved claw tool assembly and a dual-grooved claw tool assembly.

4. The framing hammer assembly of claim 3 wherein the select uni-grooved claw tool assembly is selected from the group consisting of a V-shaped groove claw assembly and a U-shaped groove claw assembly.

5. The framing hammer assembly of claim 4 wherein the dual-grooved claw assembly comprises first and second U-shaped grooves, the first U-shaped groove extending substantially parallel to the y-z plane, the second U-shaped groove extending diagonally relative to the y-z plane.

6. The framing hammer assembly of claim 5 wherein the distance-measurement means are defined by a series of equally-spaced indicia, the equally-spaced indicia being longitudinally spaced adjacent the handle axis.

7. The framing hammer assembly of claim 6 wherein the fulcrum is integrally formed with the hammer head and comprises three fulcrum dimensions, the third fulcrum dimension extending along an x-axis for enhancing the operative strength of the fulcrum.

8. A framing hammer assembly, the framing hammer assembly for tending to nail work within tight spaces, the framing hammer assembly comprising a three-dimensional hammer head, an elongate hammer handle, and a select tool attachment assembly, the hammer head inherently extending along an x-axis, a y-axis, and a z-axis and comprising first and second nail-striking heads and a nail-pulling claw, the first nail-striking head having a first head axis, the second nail-striking head having a second head axis, the first head axis extending through a first strike plane, the first strike plane defined by the y-z plane, the second head axis extending orthogonally to the first strike plane in a second strike plane, the second strike plane being defined by the x-z plane, the hammer handle comprising a handle axis, a first handle end, a second handle end, a head-engagement portion, and a hand-grip portion, the first handle end and the head-engagement portion being cooperatively associated with the hammer head for enabling the user to drive nails, the second nail-striking head and the hammer handle for enabling a user to drive nails within tight spaces, the second handle end comprising tool assembly-receiving means for receiving the select tool attachment assembly, the tool assembly-receiving means being defined by female fastener-receiving structure and male alignment structure, the fastener-receiving structure having an aperture axis and the alignment structure having a protrusion axis, the aperture and protrusion axes being coplanar with the x-z plane, the handle-engaging portion comprising an attachment aperture and an aligmnent aperture, the aligmnent aperture receiving the alignment structure, the attachment aperture being centered about the aperture axis, the select tool attachment assembly comprising a select tool accessory and handle attachment-means for fastening the select tool accessory to the second handle end via the fastener-receiving structure, the select tool accessory being interchangeable with a plurality of secondary tool accessories, the select tool attachment assembly and the hammer handle for providing a lever arm and for enabling the user to remove driven nails within tight spaces, the select tool accessory comprising a planar handle-engaging end portion and a substantially planar nail-removing end portion, the handle-engaging and nail-removing end portions being substantially orthogonal to one another, the nail-removing end portion being cooperable with a driven nail for enabling the removal thereof.

9. The framing hammer assembly of claim 8 wherein the select tool attachment assembly is selected from the group consisting of a lever attachment accessory, a V-shaped groove claw assembly, a U-shaped groove claw assembly, and a dual-grooved claw assembly, the dual-grooved claw assembly comprising first and second grooves, the first groove extending substantially parallel to the x-z plane, the second extending diagonally adjacent the x-z plane.

* * * * *